US006502565B2

(12) United States Patent
Schmid et al.

(10) Patent No.: US 6,502,565 B2
(45) Date of Patent: Jan. 7, 2003

(54) RECIPROCATING INTERNAL COMBUSTION ENGINE INCLUDING A CAMSHAFT

(75) Inventors: Martin Schmid, Berghülen (DE); Hans Brüggemann, Winterbach (DE); Hansjörg Finkbeiner, Weilheim (DE)

(73) Assignee: Daimler Chrysler A.G., Stuttgart (DE)

( * ) Notice: Subject to any disclaimer, the term of this patent is extended or adjusted under 35 U.S.C. 154(b) by 0 days.

(21) Appl. No.: 10/041,969

(22) Filed: Jan. 7, 2002

(65) Prior Publication Data

US 2002/0083933 A1 Jul. 4, 2002

Related U.S. Application Data

(63) Continuation-in-part of application No. PCT/EP00/04586, filed on May 20, 2000.

(51) Int. Cl.[7] ..... F01M 1/00
(52) U.S. Cl. ..... 123/572
(58) Field of Search ..... 123/572, 573, 123/574, 41.86

(56) References Cited

U.S. PATENT DOCUMENTS

| | | | | |
|---|---|---|---|---|
| 3,561,195 A | | 2/1971 | Bourn et al. | |
| 4,049,401 A | | 9/1977 | Smith | |
| 4,651,704 A | | 3/1987 | Sekiguchi | |
| 5,261,380 A | | 11/1993 | Romano | |
| 5,954,035 A | * | 9/1999 | Hofer et al | 123/573 |

FOREIGN PATENT DOCUMENTS

| | | |
|---|---|---|
| DE | 42 37 128 | 1/1994 |
| DE | 197 06 383 | 9/1998 |
| JP | 03 160107 | 7/1991 |
| JP | 08 177450 | 7/1996 |

* cited by examiner

*Primary Examiner*—Marguerite McMahon
(74) *Attorney, Agent, or Firm*—Klaus J. Bach

(57) ABSTRACT

In a reciprocating internal combustion engine in which a camshaft for actuating the gas exchange valves is disposed in a space, which is in communication with the engine crankcase to receive the vent gases therefrom, and the camshaft includes an axial passage and at least one radial bore and the axial passage is in communication with the engine intake duct for drawing vent gases from the crankcase to the engine intake duct through the camshaft, a disc provided with a radial disc bore is mounted onto the camshaft such that the disc bore is in alignment with the radial camshaft bore and the disc has an axial bore extending therethrough so as to intersect the radial disc bore adjacent the circumference of the disc, whereby vent gases entering the axial disc bore are accelerated in the axial bore and, upon entering the radial bore, oil particles are discharged outwardly through the radial disc bore while the gases flow inwardly through the radial disc bore to the camshaft passage and to the engine intake duct.

3 Claims, 1 Drawing Sheet

RECIPROCATING INTERNAL COMBUSTION ENGINE INCLUDING A CAMSHAFT

This is a Continuation-In-Part application of international application PCT/EP00/04586 filed May 5, 2000 and claiming the priority of German application 199 31 740.2 filed Jul. 8, 1999.

BACKGROUND OF THE INVENTION

The invention relates to a reciprocating internal combustion engine including a crankshaft for actuating gas exchange valves and a crankcase vent, which is in communication with the engine intake ports by way of an oil separator.

In reciprocating piston internal combustion engines combustion gases enter the crankcase by way of the piston rings because of the reciprocating movement of the piston and he high gas pressure in the engine cylinders. These combustion gases which are also called "blow-by" gases increase the pressure in the crankcase. They detrimentally affect the lubricating oil and furthermore make it difficult to seal the crankcase. The crankcase is therefore vented. Generally, this is provided for by a connection between the crankcase and the engine air intake system. In this way, no emissions reach the environment. In order to keep the lubricating oil, which is contained in the crankcase gases in a finely distributed form, from the engine air intake system, oil separators are disposed in the communication line interconnecting the crankcase and the engine air intake system through which the crankcase gases are conducted before they enter the intake system and in which oil contained in the crankcase gases is separated from the crankcase vent gases.

Such a piston-type internal combustion engine is disclosed for example in U.S. Pat. No. 4,651,704. This publication discloses an internal combustion engine with a crankcase venting system and an oil separator wherein a hollow camshaft that is, more accurately, a camshaft with a bore extending therethrough is utilized as a separator for the heavy oil particles contained in the crankcase vent gases. From the bore extending axially through the camshaft radial bores lead to the space surrounding the camshaft. The axial bore is in communication with the air intake system by way of a breather space. In this particular engine, the camshaft is disposed above the gas exchange valves in the cylinder head of the engine. The surrounding space is in communication with the crankcase, so that the crankcase vent gases are conducted to the air intake system by way of the radial bores and the axial bore of the camshaft. Because of the high speed of the camshaft, the heavier oil particles contained in the vent gases are thrown outwardly out of the radial bores, whereas the lighter gas components flow, because of the pressure drop to the intake system, inwardly through the radial bores and the axial camshaft bore to the engine intake system.

It is the object of the present invention to improve the effectiveness of such an oil separation system.

SUMMARY OF THE INVENTION

In a reciprocating internal combustion engine in which a camshaft for actuating the gas exchange valves is disposed in a space, which is in communication with the engine crankcase to receive the vent gases therefrom, and the camshaft includes an axial passage and at least one radial bore and the axial passage is in communication with the engine intake duct for drawing vent gases from the crankcase to the engine intake duct through the camshaft, a disc provided with a radial disc bore is mounted onto the camshaft such that the disc bore is in alignment with the radial camshaft bore and the disc has an axial bore extending therethrough so as to intersect the radial disc bore adjacent the circumference of the disc, whereby vent gases entering the axial disc bore are accelerated in the axial bore and, upon entering the radial bore, oil particles are discharged outwardly through the radial disc bore while the gases flow inwardly through the radial disc bore to the camshaft passage and to the engine intake duct.

It is essential in accordance with the invention that the centrifugal forces acting or the vent gas and the oil particles when entering the radial bores are relatively high in order to greatly improve the separation effect in the radial bore extending now through the disc mounted on the camshaft. The disc can be formed integrally with the camshaft or it can be a separate component, which is mounted onto the camshaft by pressing, clamping, bolting cementing, brazing or welding.

The axial bore may extend centrally through the camshaft if the camshaft bearings are lubricated from without. If the camshaft bearings are lubricated by way of lubricant passages extending through the camshaft, the axial vent bore extends somewhat displaced radially, with respect to the lubricating oil passage, both systems being strictly separated from each other.

The disc includes, in addition to the radial bore, at least one bore, which extends parallel to the camshaft axis and intersects the radial bore. The crankcase vent gases which enter through this parallel bore are accelerated in the parallel bore and are separated by the centrifugal forces, so that, when reaching the radial bore, the oil particles are thrown outwardly whereas the vent gases, free of any oil particles, flow inwardly to the lower pressure axial crankshaft bore and from there to the engine intake system.

The invention will be described below in greater detail on the basis of the accompanying drawings, which show the state of the art and the arrangement according to the invention in a side-by-side comparison.

DESCRIPTION OF A PREFERRED EMBODIMENT

Figure 1:
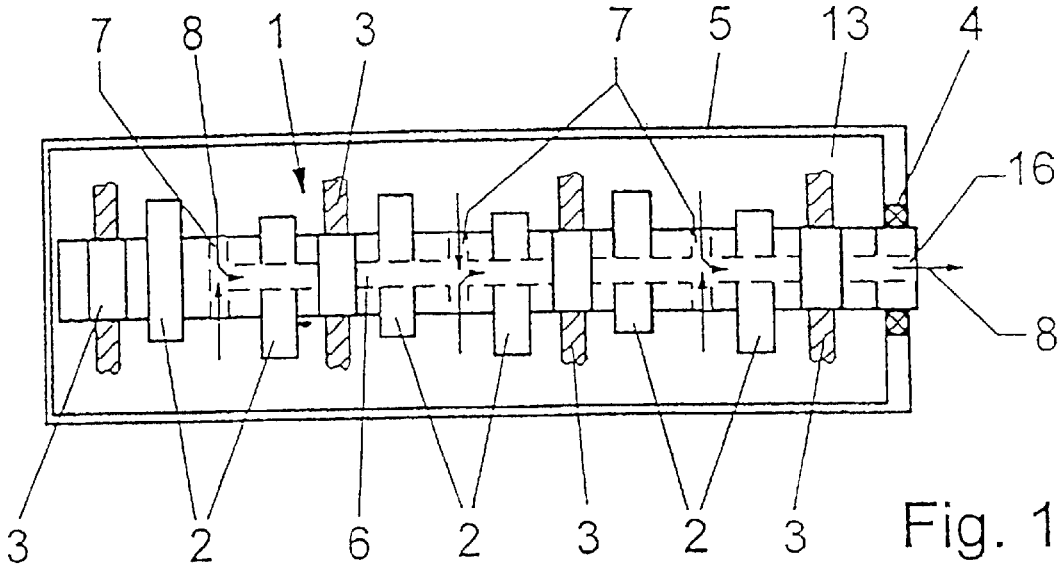
Fig. 1 (Prior Art)
FIG. 1 shows schematically a cylinder head of a reciprocating internal combustion engine with a prior art camshaft vent gas separation system.

FIG. 1 shows a crankshaft 1 of a reciprocating internal combustion engine utilizing the camshaft for separating oil from the crankcase vent gases as disclosed in U.S. Pat. No. 4,651,704. The camshaft 1, which is provided with cams 2, is rotatably supported in a housing 5 by way of bearings 3. At one end, the camshaft is sealed by a seal 4 with respect to the housing 5. The housing 5 may be a cylinder head of a reciprocating internal combustion engine and encloses a space 13 in which he camshaft 1 is disposed and which is in communication with a crankcase that is not shown. The camshaft 1 includes an axial bore 6, from which radial bores 7 extend to the space 13. The axial bore 6 of the camshaft 1 is provided at one axial end thereof with an outlet 16, which is in communication with an engine intake system that is not shown.

Because of a pressure difference between the crankcase of the engine and the engine intake duct, crankcase vent gases are drawn through the radial bores 7 and the axial bore 6 as well as the outlet 16 to the engine intake duct. The flow direction of the crankcase vent gases is indicated in FIG. 1 by he arrows 8. Because of the rotation of the camshaft 1, the vent gases entering the radial bores 7 are subjected to centrifugal forces which are greater for the oil particles then they are for the gases because of the greater mass of the oil particles. As a result, the oil particles are thrown outwardly while the lighter gases flow against the centrifugal forces inwardly into the axial camshaft bore, driven by the pressure drop, toward the engine intake duct.

Figure 2:
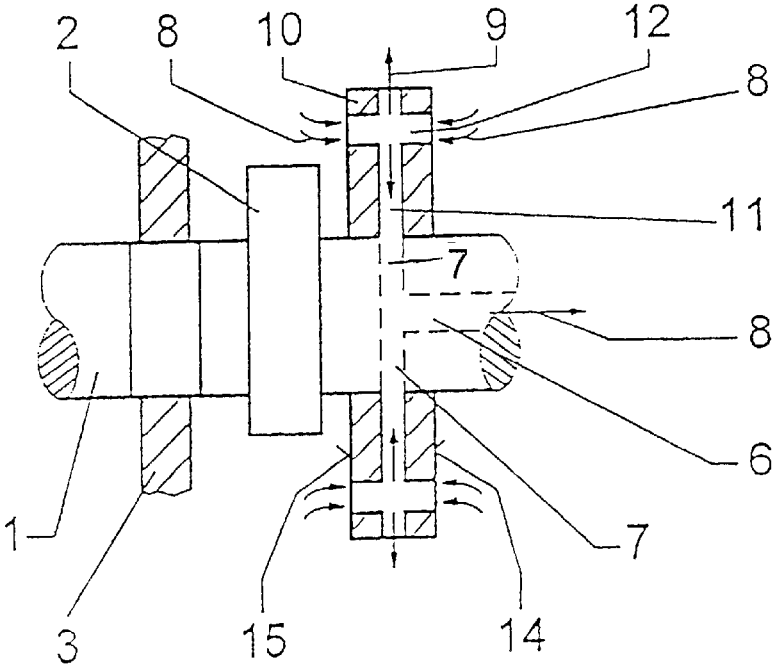
FIG. 2 shows a camshaft of a reciprocating internal combustion engine with a vent gas separating system according to the invention.

In order to increase the centrifugal forces and thereby to improve the oil separation from the vent gases, a disc 10 is mounted onto the camshaft 1 in the area of the radial bores 7 as shown in FIG. 2. The disc 10 includes radial disc bores 11, which are disposed in alignment with the radial camshaft boresbores 7. As a result, the circumferential speed of the bores 11 at the circumference of the disc 10 is substantially increased whereby also the centrifugal forces are also increased.

In order to further improve the separation of the oil particles from the crankcase vent gases, the disc 10 Was provided in an area adjacent its outer circumference with axial bores 12, which intersect the radial bores 11 of the disc 10 and have axial openings at the opposite axial faces 14, 15 of the disc 10. The vent gases will then enter the disc through the axial bores 12 and will be accelerated in the axial bores 12 before the enter the radial bores 12. Upon entering the radial bore 12, the oil particles—already accelerated and subject to the high centrifugal forces—will move immediately outwardly through the outer end of the radial bore 11 as indicated by the arrow 9 whereas the lighter vent gas components flow inwardly and through the radial bore 7 of the camshaft 1 into the axial camshaft bore 6. The disc 10 is connected to the camshaft 1 in any suitable manner, for example, by a press fit, by cementing, by bracing, or by welding. It may also be formed integrally with the camshaft 1.

What is claimed is:

1. A reciprocating internal combustion engine including a crankcase, a cylinder head with gas exchange valves, a camshaft for actuating the gas exchange valves of the engine, said camshaft being disposed in a space, which is in communication with the crankcase of the engine so as to receive vent gases from said crankcase, and including an axially extending passage within said camshaft with at least one radial bore extending to said space surrounding said camshaft, said axially extending passage being in communication with an engine intake duct, and a disc disposed on said camshaft in the area of said radial bore and including a radial disc bore arranged in alignment with said radial camshaft bore, said disc being provided also with an axial bore formed so as to intersect said radial bore near the circumference of said radial disc, whereby vent gases entering said axial bores are accelerated in said axial bore before entering said radial bore where oil particles in the vent gases are thrown out of the disc through the radial bore while the lighter vent gas components flow inwardly through the radial bore to the axial crankshaft bore and to the engine intake duct.

2. A reciprocating internal combustion engine according to claim 1, wherein said disc is formed integrally with said camshaft.

3. A reciprocating internal combustion engine according to claim 1, wherein said disc is mounted onto said camshaft by one of a press fit, by clamping, by bolting, by cementing, by brazing and by welding.

* * * * *